US005941321A

United States Patent [19]

Hughes

[11] Patent Number: 5,941,321

[45] Date of Patent: Aug. 24, 1999

[54] METHOD AND APPARATUS FOR DRILLING A PLANAR CURVED BOREHOLE

[76] Inventor: W. James Hughes, 406 S. Boulder, Tulsa, Okla. 74103

[21] Appl. No.: 09/122,596

[22] Filed: Jul. 27, 1998

[51] Int. Cl.[6] ..... E21B 7/08

[52] U.S. Cl. ..... 175/61; 175/73; 175/76; 175/325.1

[58] Field of Search ..... 175/61, 73, 76, 175/325.1

[56] References Cited

U.S. PATENT DOCUMENTS

| | | | |
|---|---|---|---|
| 4,076,084 | 2/1978 | Tighe . | |
| 4,305,474 | 12/1981 | Farris et al. | 175/76 |
| 4,465,147 | 8/1984 | Feenstra . | |
| 5,423,389 | 6/1995 | Warren et al. | 175/76 |
| 5,467,834 | 11/1995 | Hughes et al. | 175/61 |
| 5,547,031 | 8/1996 | Warren et al. | 175/73 |

*Primary Examiner*—David J. Bagnell
*Assistant Examiner*—Chi H. Kang
*Attorney, Agent, or Firm*—William S. Dorman

[57] ABSTRACT

A Method and Apparatus for drilling a curved planar borehole, wherein a drill bit is mounted at the lower end of a drill string which extends downwardly into the borehole, and wherein fluid under pressure is pumped through the drill string, a drilling motor for rotating the drill bit, a specialized drill sub mounted in the drill string above the drilling motor, an eccentric sleeve rotatably mounted over the drill sub, an alignment mechanism attached to the eccentric sleeve, a deflection device mounted in the sleeve for bearing against one side of the wellbore, whereby, when fluid under pressure is introduced into the drill sub, the deflection device will move outwardly against the side of the wellbore, the alignment mechanism being such that the drill sub can rotate independently of the eccentric sleeve to prevent reactive torque from the drilling motor from being exerted against the sleeve and the deflection device.

5 Claims, 4 Drawing Sheets

METHOD AND APPARATUS FOR DRILLING A PLANAR CURVED BOREHOLE

CROSS REFERENCE TO RELATED APPLICATIONS

The present invention is an improvement over the invention disclosed and claimed in my prior U.S. Pat. No. 5,467,834, issued Nov. 21, 1995 on a "METHOD AND APPARATUS FOR SHORT RADIUS DRILLING OF CURVED BOREHOLES".

BACKGROUND OF THE INVENTION

1. Field of the Invention

This invention relates to a method and apparatus for the drilling of a planar curved borehole. More particularly, this invention constitutes an improvement over the invention disclosed and claimed in the aforementioned prior patent.

2. The Prior Art

It is generally known that the final portion of a rotary drilling string (the so-called drilling collar) or the like is under compressive loads and torque during drilling, while the upper portion of the drilling string is under tension. As such, the weight of the drill collar below the point of last contact with the borehole wall may be thought of as being divided into two components; one acting along the axis of the collars and the second acting normal to the first, perpendicular to the borehole.

It is also generally known that, in principle, if the downhole orientation and magnitude of the normal force could be controlled during drilling, the drill bit could essentially be steered to any desired subsurface location or strata. Although theoretically possible and highly desirable, such a process and corresponding drilling equipment to achieve such a goal have not yet been developed. However, various processes and associated equipment have been employed that generally achieve varying degrees of what is recognized in the art as directional drilling. For example, it is common practice in oil and gas well drilling to use a so-called "whipstock" (a sloped plug inserted below the drill bit) to intentionally deflect the drill bit in a desired direction, thus creating a deviation in the direction of drilling.

Various types of drilling collar stabilizers have also been proposed to alter the direction of drilling. For example, U.S. Pat. Nos. 4,305,474 and 4,465,147 disclose stabilizers that create a deflecting force perpendicular to the drill string in order to control and guide the drill bit along a desired course of direction. Also, the use of an eccentric stabilizer has been proposed in U.S. Pat. No. 4,076,084 to drill a directionally oriented hole such as commonly practiced when drilling from an offshore platform or the like.

Another method and apparatus for drilling a curved borehole is disclosed in my prior U.S. Pat. No. 5,467,834, issued on a "METHOD AND APPARATUS FOR SHORT RADIUS DRILLING OF CURVED BOREHOLES". The present invention, in part, is an improvement over the invention disclosed in the aforementioned prior patent; the latter patent discloses a drilling sub located near the downhole end of a drilling string above the drill bit. The drill sub has an eccentric sleeve mounted thereon. The sleeve is provided with a retractable sidewall engaging means. The sidewall engaging means forces the drill string passing therethrough to one side of the well bore, thus lever arming the drill bit to the other side of the well bore by pivoting the lower end of the drill string. The retractable sidewall engaging means prevents the eccentric sleeve from rotating (in conjunction with the grooves on the opposite thin side of the sleeve) in the well bore, thus resulting in a curved well bore.

It is an object of the present invention to provide a downhole drilling method and apparatus which includes a drill string, a specialized drill sub mounted in the drill string adjacent the lower end thereof, an eccentric sleeve mounted on the drill sub, the sleeve being provided with a retractable sidewall engaging means and where and alignment device is mounted between the eccentric sleeve and the drill sub for permitting rotation of the drill sub relative to the eccentric sleeve after the retractable sidewall engaging means has been actuated to engage the side of the wellbore.

It is a further object of the present invention to provide a downhole drilling method and apparatus of the type referred to in the preceding paragraph wherein the permitted rotation of the drill sub serves to eliminate the effect of reactive torque from the drilling operation upon the eccentric sleeve.

SUMMARY OF THE INVENTION

The present invention includes an apparatus for drilling a curved planar borehole. The drill bit is mounted at the lower end of a drill string which extends downwardly into the borehole. A drilling motor is mounted adjacent the lower end of the drill string above the drill bit. As specialized sub is mounted in the drill string above the drilling motor and a fluid conducting flexible joint is connected between the specialized drill sub and the drill string. The specialized sub includes a mandrel having an outer cylindrical surface whose diameter is less than the normal outer diameter of adjacent sections of the drill string. An eccentric sleeve is mounted over the mandrel to rotate eccentrically with respect to the same. The eccentric sleeve has an inner diameter greater than the outer diameter of the mandrel so as to form an annular space between the mandrel and the eccentric sleeve. An alignment mechanism in the form of a thin sleeve is mounted within the annular space and is attached to the eccentric sleeve. The eccentric sleeve has a thick wall and a thin wall and a deflection device is mounted in the thick wall and is adapted to bear against one side of the wellbore so as to urge the thin wall of the eccentric sleeve against the opposite side of the well bore, thereby tilting the drill string away from the longitudinal axis of the wellbore. A sliding tube is received within the inner bore of the mandrel for vertical sliding movement therein. A coiled spring urges the sliding tube vertically upward.

A piston extends laterally through the thick wall of the eccentric sleeve and connects with a deflection device for urging the same against one side of the wellbore. A retaining plug is mounted on an end of the piston opposite from the attachment thereof to the deflection device. A spring is mounted between the retaining plug and the thick wall of the eccentric sleeve for urging the piston inwardly. The sliding tube has a laterally extending guide key received in a vertical slot in the mandrel. The alignment mechanism is provided with a notch in one side thereof adjacent the location of the piston for receiving the guide key therein. The alignment mechanism is provided with a lower tip on the opposite side of the alignment mechanism from the notch and extending downwardly to a location opposite the lower end of the slot in the mandrel, whereby when fluid under pressure is introduced into the drill sub, the sliding tube will move downwardly against the action of the coiled spring, the guide key moving to the lower end of the vertical slot in a position laterally below the lower tip of the alignment mechanism. The fluid pressure also acts on the retaining plug to push the piston outwardly and thereby push the deflection device against the side of the wellbore. The fluid pressure further actuates the drilling motor for rotating the drill bit. The location of the guide key below the tip of the alignment mechanism is such that the mandrel can rotate independently of the eccentric sleeve to prevent reactive torque from the drilling motor from being exerted against the sleeve and the deflection device.

DETAILED DESCRIPTION OF THE PREFERRED EMBODIMENTS

Figure 1:
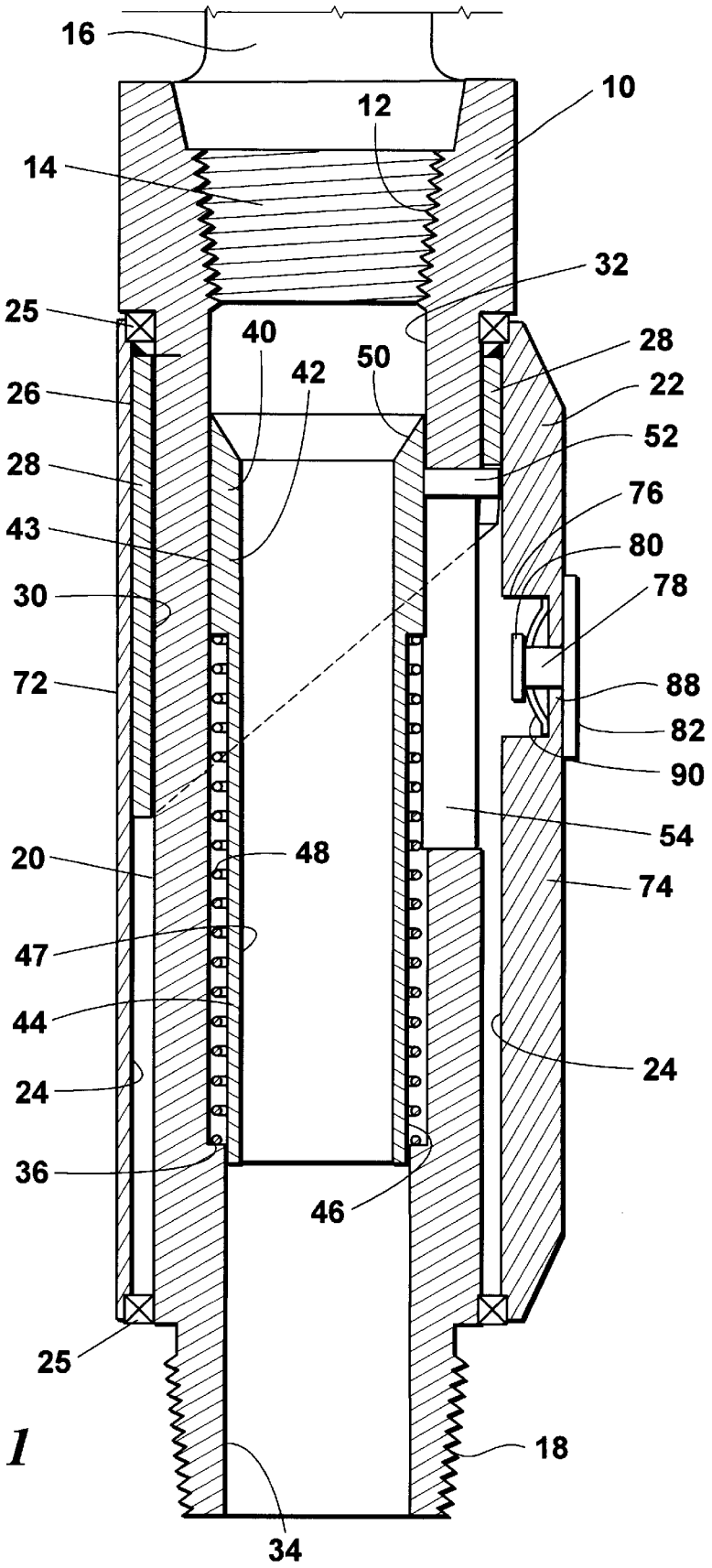
FIG. 1 is a longitudinal sectional view of a portion of a drill string embodying the present invention.
Figure 2:
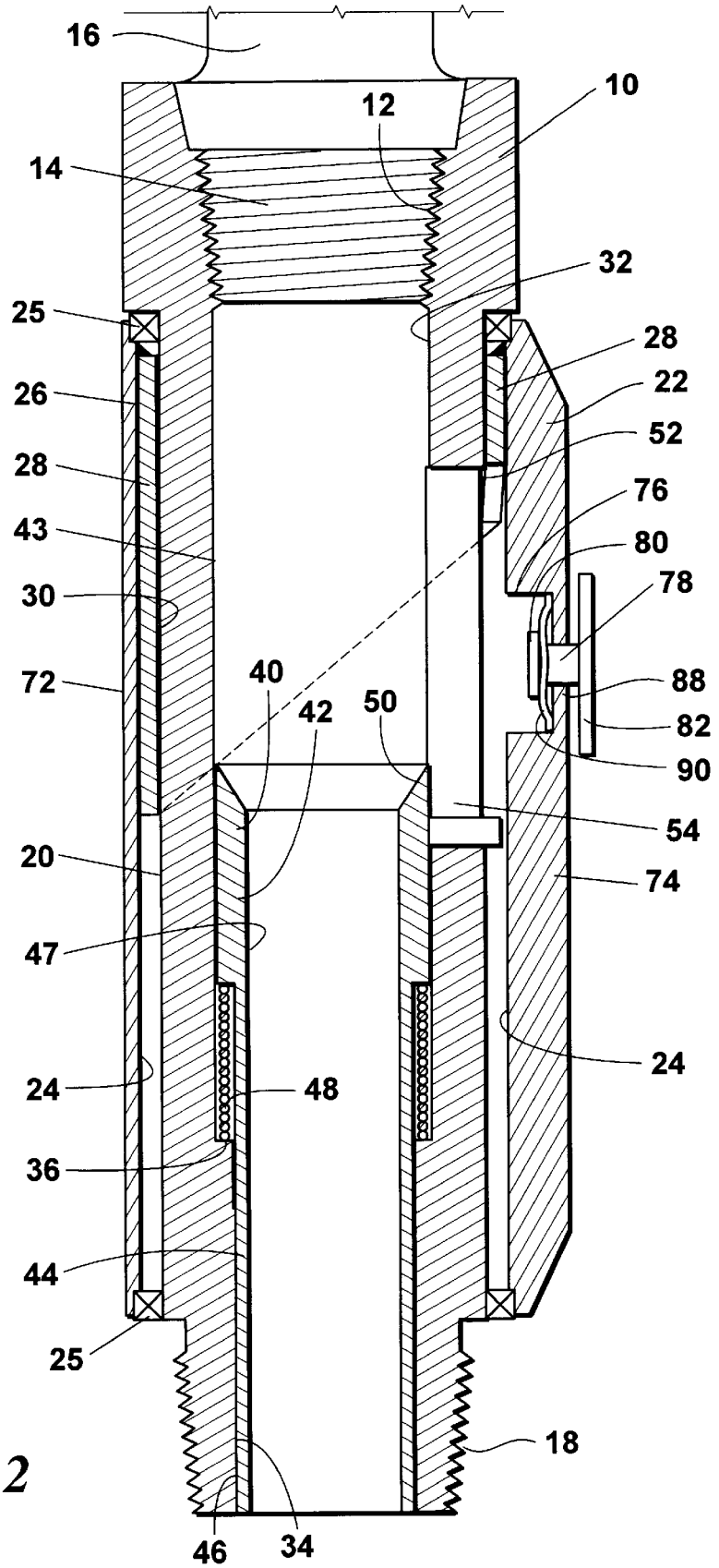
FIG. 2 is view similar to FIG. 1, but showing the changed positions of certain elements as a result of an increased fluid pressure in the drill string.

Referring to the drawings in detail, FIGS. 1 and 2 show a drill pipe sub 10 which has been modified and ported in a manner later to be described. The drill sub 10 is provided with female threads 12 which mate with the male threads 14 on the lower end of an upper piece of drill pipe 16. The drill pipe 16 (not shown in further detail) is one of a plurality of vertical drill pipes which has been connected together to make a semi-rigid drill string. The lower end of the drill sub 10 is provided with male threads 18 which can be adapted to mate with another drill sub or drill pipe section or mud motor, as will be later described.

Between the female threads 12 at the upper end and the male threads 18 at the lower end, the drill pipe sub 10 is provided with a portion 20 of reduced diameter, hereinafter referred to as a mandrel, but having an outer cylindrical surface on which is received an eccentric cylindrical collar or sleeve 22. The outer cylindrical surface 20 of the drill pipe sub 10 is less than the normal outer diameter of adjacent sections (not shown) of the drill string; the outer cylindrical surface 20 extends for substantially the entire vertical length of the drill sub 10 as shown in drawings.

Sleeve 22 has an outer diameter which exceeds the diameter 20 of the mandrel, but which has a hole or bore 24 therein which is offset from the central cylindrical axis of the sleeve 22 itself. Two bearing seals 25, 25 are located at the upper and lower ends of the eccentric sleeve 22 and provide surfaces on which the mandrel 20 can spin inside the non-rotating eccentric sleeve. The hole 24, however, has a diameter equal to the outer diameter 26 of an alignment mechanism 28 which will be further described in relation to the description of FIGS. 3, 4, and 5. Briefly, however, the alignment mechanism 28 is a short tapered cylindrical element which is mounted on the mandrel 20 of the pipe sub 10. The alignment mechanism 28 has an inner diameter 30 which is equal to the outer diameter of the mandrel 20. The alignment mechanism 28, therefore, is in the form of a relatively thin sleeve which is mounted within the annular space between the surface 20 and the sleeve 22. The alignment mechanism is attached to the inside of the eccentric sleeve 22 by any convenient method, as for example, welding. Alternatively the sleeve 22 and the alignment mechanism can by machined as a single piece.

The relationship of the elements is such that the eccentric sleeve 22 and the alignment mechanism 28 can rotate around the pipe sub 10 in a manner similar to that of a cam.

The pipe sub 10 is provided with an inner bore which is sub-divided into an upper bore 32 and a lower bore 34 of slightly smaller diameter than the upper bore 32. The upper bore 32 extends down to a location slightly above the lower threaded portion 18 and forms a shoulder 36 where the upper bore meets the lower bore.

A sliding tube 40 is mounted for sliding movement within the central bore of the pipe sub 10. The sliding tube 40 has an upper portion 42 which has an outer diameter 43 exactly or substantially equal to the diameter of the upper bore 32 and a lower elongated portion 44 which has an outer diameter 46 substantially equal to the diameter of the lower bore 34 and an inner diameter 47. Between the outer diameter 46 of the lower portion 44 and the inner bore 32, there is created an annular space in which is received a coiled spring 48.

The upper end of the sliding tube 40 is provided with a tapered throat 50 which extends downwardly from the outer diameter 43 of the upper portion 42 to the inner diameter 47. This tapered throat makes the sliding tube responsive to pressures within the drill string as will be described hereinafter.

Figure 6:
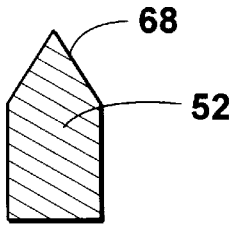
FIG. 6 is a transverse sectional view of the guide key shown in FIGS. 1 and 2.

Extending outwardly from the upper portion 42 of the sliding tube 40 is a horizontally extending guide key 52. The guide key is received in a vertical slot 54 provided in the mandrel. The slot is essentially equal in width to the width of the guide key 52 as shown in FIG. 6. The outer end of the guide key 52 terminates at or near the inner diameter 24 of the eccentric sleeve 22.

Figure 4:
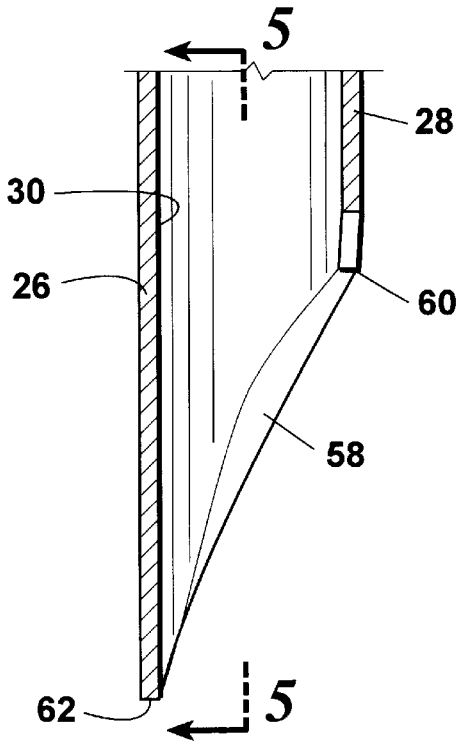
FIG. 4 is a longitudinal sectional view taken along line 4—4 of FIG. 3.
Figure 3:
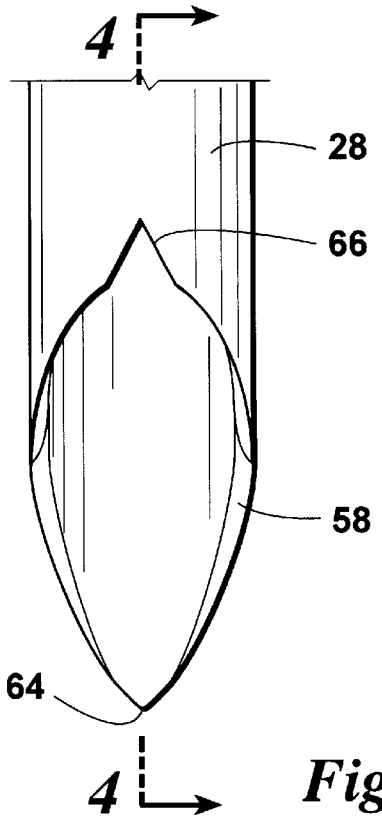
FIG. 3 is right-hand elevation of the alignment mechanism shown in FIGS. 1 and 2.
Figure 5:
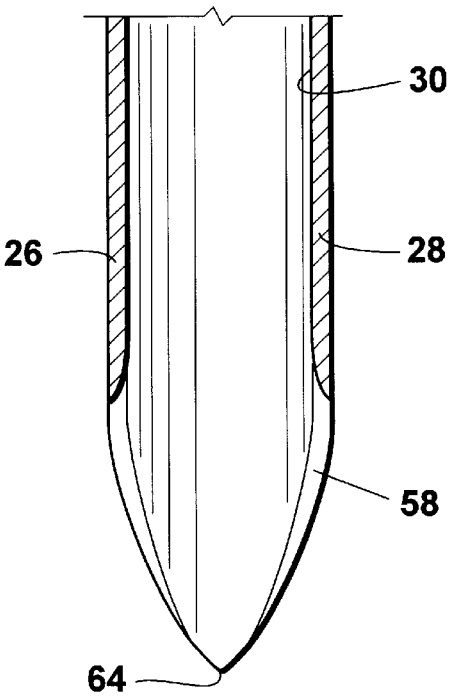
FIG. 5 is a longitudinal section view taken along line 5—5 of FIG. 4.

As best shown in FIGS. 3, 4, and 5, the alignment mechanism 28 has a lower tapered end 58 which extends from approximately point 60 on the upper right-hand portion, as the alignment mechanism appears in FIG. 4, to a lower point 62 at the left-hand portion of FIG. 4. In side elevation FIG. 3, the tapered end 58 appears to be elliptical in shape. Actually, the lower end of the tapered surface 58 terminates in a tip or point 64.

Above the location 60, the alignment mechanism 28 is provided with a notch 66 which is in the shape of an inverted V and which is in alignment with the lower tip 64.

The guide key 52 is primarily rectangular in cross section; however, the upper edge of the guide key 52 is provided with an inverted V-shaped projection 68 which is shaped in the same fashion as the notch 66 and which is adapted to be received in the notch 66 when the various elements are in the relative positions shown in FIG. 1.

Figure 7:
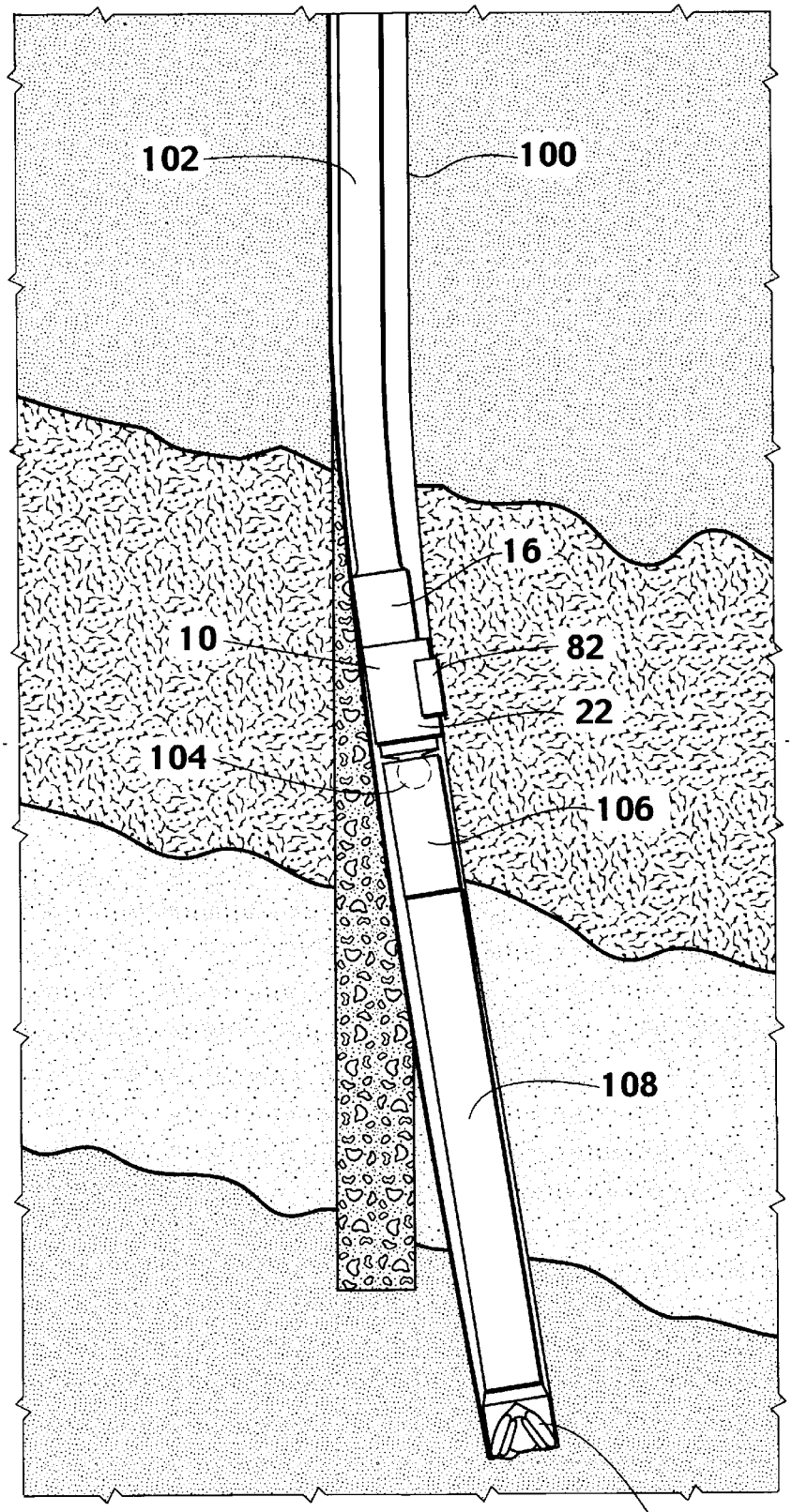
FIG. 7 is a semi-diagrammatic representation of a drill string employing the present invention on the lower portion thereof, together with a drilling (mud) motor, and showing the device of the present invention as it commences to drill on a deviant path from the preceding well bore.

Turning now to a further consideration of FIGS. 1 and 2, because of the fact that the eccentric sleeve 22 is provided with an opening 24 which is offset from the central longitudinal axis of the sleeve itself, the sleeve has a relatively thin portion 72 appearing at the left on FIGS. 1 and 2 and a relatively thick portion 74 appearing to the right. The thick portion 74 is provided with a recess 76 which extends radially outward from the inner surface 24 toward the outside of the sleeve. This recess could be rectangular or circular in cross-section. However, a piston 78 is centrally mounted with respect to the recess 76 and is oriented in a horizontal direction. The inner end of the piston 78 is provided with a disk shaped retaining plug 80 which is of slightly larger diameter than the outer diameter of the piston 78 itself. The outer portion of the piston 78 is provided with a deflection device 82 whose purpose will hereinafter appear. This deflection device is external of the sleeve 22. As will also be indicated hereinafter, the deflection device 82 is adapted to be urged outwardly by the fluid pressure in the drill string against one side of the well bore; this action will cause the other thin side 72 of the sleeve 22 to engage the opposite side of the well bore and thereby causing the lower end of the drill string to be canted or tilted away from the longitudinal axis of the well bore above the drill sub 10 such that the drill bit will tend to drill in a direction away from the longitudinal axis of the drill bore as shown in FIG. 7.

The outer surface of the deflection device and the outer surface of the thin portion 72 on the opposite side of the sleeve from the deflection device are both shown as smooth in FIGS. 2 an 3 for the sake of simplicity. Preferably, however, the outer surface of the deflection device 82 and the outer surface of the thin portion 72 opposite thereto will be both provided with vertical grooves (not shown) similar to the vertical grooves 40 shown in FIGS. 3, 4, 5 and 6 of prior U.S. Pat. No. 5,467,834, issued Nov. 21, 1995 on a "METHOD AND APPARATUS FOR SHORT RADIUS DRILLING OF CURVED BOREHOLES". These grooves will tend to keep the drill sub 10 from rotating as the drilling operation proceeds downwardly in the well bore.

The relatively thin wall which separates the inner portion of the recess 76 from the outside of the sleeve 22 is provided with a central hole or opening 88 which is adapted to slidably receive the piston 78. A leaf spring 90 is mounted between the retaining plug 80 and the (radially) outermost portion of the recess 76. This leaf spring is also provided with a central opening substantially equal to the diameter of the opening 88 in the outer wall of the eccentric sleeve 22.

When the fluid pressure is now increased in the bore of the combined drill string, there will be two resulting effects:

First of all, the increased pressure of the fluid within the drill string will be exerted against the inclined surface 50 at the top of the sliding tube 40 such that it will be urged downwardly against the action of the coiled spring 48. The coiled spring will be compressed as shown in FIG. 2. At the same time the bottom edge of the reduced portion 44 of the sliding tube 42 will be in alignment with the bottom of the threaded portion 18 as shown in FIG. 2. When the sliding tube is moved downwardly, as explained above, the guide key 52 will also move downwardly such that it will rest near the lower edge of the slot 54 as shown in FIG. 2.

Secondly, the increased fluid pressure will also exert a force against the retaining plug 80 causing the piston 78 to move toward the right as it appears in FIG. 2, compressing the leaf spring 90 thereby flattening it out and also moving the deflection device 82 so that it is actually spaced away from the outer edge of the eccentric sleeve 22. At this point, the deflection device will bear against the side of the well bore so as to lock the sleeve 22 in a fixed lateral position against the side of the well bore. The bearing seals 25, previously described, also serve to confine the pressure to the annular area defined by the mandrel, the eccentric sleeve and the seals themselves.

Actuation of the deflection device 82 so that it engages one side of the well bore will push the other thin portion 72 of the sleeve 22 against the opposite side of the well bore thereby causing the lower end of the drill string to be canted or tilted away from the longitudinal axis of the well bore above the drill sub 10 such that the drill bit will tend to drill in a direction away from the longitudinal axis of the drill bore as shown in FIG. 7. It is contemplated that the drilling at this time can proceed through the instrumentality of the mud motor (later to be described). However, because of the arrangement achieved in FIGS. 1 and 2 it is still possible to rotate the drill bit by rotating the drill string. This is possible because the pressure inside the drill string not only has moved the deflection device against the side of the well bore but also the guide key 52 is now moved to the lower end of the slot 54 and actually below the lower tip 64 of the alignment mechanism 28; this means that a turning of the drill sub 10 is possible because the guide key can rotate 360 degrees without any interference from the tip 64 of the alignment mechanism.

The above described arrangement of the relative members whereby the guide key 52 is located below the lower tip 64 of the alignment mechanism 28 when the drill pipe is pressurized has a second purpose; that is, in certain instances there may be some reactive torque from the mud motor 10 (later to be described) which will tend to rotate the mandrel. If the mandrel were rotatably locked relative to the sleeve 22, this reactive torque would tend to rotate the deflection device 82 away from its position against the side of the well bore and thereby change the direction (plane) of the deviation of the drilling. However, since the guide key 52 is positioned below the tip 64, the mandrel 20 can rotate independently of the sleeve 22 and take the effect of the reactive torque of the mud motor away from the deflection device.

Referring now to FIG. 7, there is shown a well bore 100 which is essentially vertical at its upper end, and which extends downwardly beneath the surface of the ground through numerous and varied subterranean strata (not numbered) some of which may be oil-bearing. A drill string 102 extends vertically downwardly in the well bore 100 and connects with the drill pipe section 16 which, in turn, connects with drill pipe sub 10 in which the present invention is incorporated. Previously it has been noted that the lower threaded end 18 of the sub 10 can be connected to another drill pipe section or a mud motor.

For the purposes of FIG. 7, the lower threaded portion 18 of the drill sub 10 can be considered as connected to a ball element 104 which has an end (not shown) with female threads (not shown) adapted to mate with the threads 18 on the lower end of the pipe sub 10. The ball 104 is received in a ball socket (not shown) at the end of a flexible joint 106 which, in turn, connects with the upper end of a mud motor 108. A drill bit 110 is located at the lower end of the mud motor. As the internal mechanism (not shown) in the mud motor rotates as a result of fluid pressure from above, the drill bit 110 will rotate and create the required drilling action. Although the ball 104 and the flexible joint 106 are shown located below the pipe sub 10, obviously they could be arranged above the sub 10.

In operation, the drill string 102 is lowered into the well bore 100 so that the deflection device 82 is oriented in the position shown in FIG. 7. This can be done by correlating the position of the deflection device 82 with a marker (not shown) at the upper end of the drill string. There are several systems for insuring that the marker (not shown) at the upper end of the drill string is in alignment with the deflection device 82 (or other orientable devices at the lower end of the drill string). One such alignment method or device which can be used is disclosed in my copending application Ser. No. 08/950,047 filed Oct. 14, 1997, and entitled "METHOD AND APPARATUS FOR ALIGNING DRILL PIPE AND TUBING".

In the event that the drill sub 10 (and drill string 102 itself) is turned as a result of the reactive torque, the alignment mechanism 28, in conjunction with the sliding tube 40 and the guide key 52, will realign the deflection device and the eccentric sleeve into the position shown in FIG. 1.

As indicated above, when pressure is introduced into the drill string from above, the first thing that happens is that the sliding tube 40 will move downwardly against the action of the spring 48. Normally, the pressure required for this would be about 100 psi. Later the piston 78 is moved outwardly as a result of pressure exerted against the retaining plug 80. This pressure would preferably be in the neighborhood of 125 psi. After the piston is moved outwardly such that the deflection device 82 is pushed against one side of the wellbore, a further increase of pressure will cause the drilling motor 108 to rotate. Generally, the pressure required to operate the drilling (mud) motor is 200–400 psi.

Whereas, the present invention has been described in particular relation to the drawings attached hereto, other and further modifications, apart from those shown or suggested herein, may be made within the spirit and scope of this invention.

What is claimed is:

1. Apparatus for causing a drill bit to drill a curved planar borehole, wherein the drill bit is mounted at the lower end of a drill string which extends downwardly into the borehole, a drilling motor also being mounted adjacent the lower end of the drill string above the drill bit for rotating the same, a specialized drill sub mounted in the drill string above the drilling motor, a fluid conducting flexible joint connected between the specialized drill sub and the drill string for facilitating the tilting of the lower end of the drill string when the drill string adjacent to the specialized drill sub is pushed from one side of the wellbore towards the opposite side, the specialized sub including a mandrel having an outer cylindrical surface whose diameter is less than the normal outer diameter of adjacent sections of the drill string and which extends for substantially the full length of the drill sub, an eccentric sleeve which is adapted to be mounted over the mandrel to rotate eccentrically with respect to the mandrel, the eccentric sleeve having an inner diameter greater than the outer diameter of the mandrel so as to form an annular space between the mandrel and the eccentric sleeve, an alignment mechanism in the form of a thin sleeve mounted within the annular space and being attached to the eccentric sleeve, the eccentric sleeve having a thick wall and a thin wall, a deflection device mounted in the thick wall of the eccentric sleeve and adapted to bear against one side of the wellbore so as to urge the thin wall of the eccentric sleeve against the opposite side of the wellbore, thereby tilting the drill string away from the longitudinal axis of the wellbore, the mandrel having an inner bore for conducting pressurized fluid therethrough, a sliding tube received within the inner bore of the mandrel for vertical sliding movement therein, a coiled spring for urging the sliding tube vertically upward, a piston extending laterally through the thick wall of the eccentric sleeve and connecting with the deflection device for urging the deflection device against one side of the wellbore, a retaining plug mounted on an end of the piston opposite from the attachment thereof to the deflection device, a spring mounted between the retaining plug and the thick wall of the eccentric sleeve for urging the piston inwardly, the sliding tube having a laterally extending guide key received in a vertical slot in the mandrel, the alignment mechanism having a notch in one side thereof adjacent the location of the piston for receiving the guide key therein, the alignment mechanism having a lower tip on the opposite side of the alignment mechanism from the notch and extending downwardly to a location opposite the lower end of the slot in the mandrel, whereby, when fluid under pressure is introduced into the drill sub, the sliding tube will move downwardly against the action of the coiled spring, the guide key moving to the lower end of the vertical slot in a position laterally below the lower tip of the alignment mechanism, the fluid pressure also acting on the retaining plug to push the piston outwardly and thereby push the deflection device against the side of the wellbore, the fluid pressure also actuating the drilling motor for rotating the drill bit, the location of the guide key below the tip of the alignment mechanism being such that the mandrel can rotate independently of the eccentric sleeve to prevent reactive torque from the drilling motor from being exerted against the sleeve and the deflection device.

2. Apparatus for drilling a curved planar borehole, wherein a drill bit is mounted at the lower end of a drill string which extends downwardly into the borehole, a drilling motor mounted in the drill string above the drill bit for rotating the same, a specialized drill sub mounted in the drill string above the drilling motor, the specialized sub including a cylindrical mandrel, an eccentric sleeve mounted over the mandrel to rotate eccentrically relative thereto, an alignment mechanism mounted between the mandrel and the eccentric sleeve and being attached to the eccentric sleeve, a deflection device mounted in the sleeve for bearing against one side of the wellbore so as to urge the drill string against the opposite side of the wellbore, the mandrel having an inner bore for conducting pressurized fluid therethrough, a sliding tube received within the inner bore of the mandrel for vertical sliding movement downwardly therein against the action of a spring, the sliding tube having a laterally extending guide key received in a vertical slot in the mandrel, the alignment mechanism having a notch in one side thereof for receiving the guide key therein, the alignment mechanism having a lower tip extending downwardly to a location opposite the lower end of the slot in the mandrel, whereby, when fluid under pressure is introduced into the drill sub, the sliding tube will move downwardly against the action of the spring, the guide key moving to the lower end of the vertical slot in a position laterally below the lower tip of the alignment mechanism, the fluid pressure also acting to push the deflection device outwardly against the side of the wellbore, the location of the guide key below the tip of the alignment mechanism being such that the mandrel can rotate independently of the eccentric sleeve to prevent reactive torque from the drilling motor from being exerted against the sleeve and the deflection device.

3. Apparatus for drilling a curved planar borehole as set forth in claim 2 wherein the eccentric sleeve has a thick wall and a thin wall, a piston extending laterally through the thick wall of the eccentric sleeve and connecting with the deflection device for urging the deflection device against one side of the wellbore, the piston being acted upon by the fluid pressure.

4. Apparatus for drilling a curved planar borehole as set forth in claim 3 wherein a retaining plug is mounted on an end of the piston opposite from its attachment to the deflection device and a spring is mounted between the retaining plug and the thick wall of the eccentric sleeve for urging the piston inwardly, the retaining plug being responsive to fluid pressure.

5. A method for drilling a curved planar borehole from an existing main borehole by means of a drilling assembly having a drill string which connects at its lower end with a drill bit and wherein fluid under pressure is pumped through a central opening in the drilling assembly during the drilling comprising:

providing a borehole drilling tool which includes an eccentric sleeve mounted circumferentially about a drill pipe sub located above the drill bit and having an alignment mechanism mounted between the eccentric sleeve and the drill pipe sub, a piston extending laterally through a cammed side of the eccentric sleeve and connecting with a deflection device for urging the deflection device against one side of the wellbore, a retaining plug mounted on an end of the piston opposite from the attachment thereof to the deflection device, the alignment device having a notch at one upper end thereof and a lower tip on the opposite lower side thereof, a sliding tube received within the inner bore of the drill pipe sub for vertical sliding movement therein, a guide key extending laterally from the sliding tube and received in a vertical slot in the drill pipe sub, drilling the curved borehole while pumping fluid under pressure through the central opening in the drilling assembly such that fluid pressure first forces the sliding tube downwardly until the guide key moves to the lower end of the vertical slot and beneath the position of the lower tip of the alignment mechanism and whereby the fluid pressure also acts against the retaining plug to move the piston and hence the deflection device against the side of the wellbore while also causing rotation of the drill bit, whereby the positioning of the guide key below the lower tip on the alignment mechanism is such that the drill sub can rotate independently of the eccentric sleeve to prevent reactive torque from the drilling motor from being exerted against the sleeve and the deflection device.

* * * * *